US006116326A

United States Patent [19]

Domina et al.

[11] Patent Number: 6,116,326

[45] Date of Patent: Sep. 12, 2000

[54] MOBILE SCREEN

[75] Inventors: Christopher Lyle Domina, San Francisco; Paul Brian Siebert; Jess Allen Sorel, both of Castro Valley; Paul Jesus Espinoza; Lewis Mark Epstein, both of San Mateo; David Eric Simon, San Francisco, all of Calif.

[73] Assignee: Steelcase Development Inc., Caledonia, Mich.

[21] Appl. No.: 09/197,178

[22] Filed: Nov. 20, 1998

[51] Int. Cl.[7] ..... A47G 5/00

[52] U.S. Cl. ..... 160/351; 160/352

[58] Field of Search ..... 160/351, 135, 160/352; 52/239, 238.1; 40/605, 606, 610

[56] References Cited

U.S. PATENT DOCUMENTS

| | | | |
|---|---|---|---|
| 138,507 | 5/1873 | Lazarus . | |
| 158,217 | 12/1874 | Low . | |
| 3,017,969 | 1/1962 | Nielsen | 189/34 |
| 3,418,765 | 12/1968 | Propst et al. | 52/36 |
| 3,463,218 | 8/1969 | Cannon et al. | 160/135 |
| 3,565,152 | 2/1971 | Cohn, Jr. et al. | 160/135 |
| 3,777,437 | 12/1973 | Christen | 52/239 X |
| 3,817,396 | 6/1974 | Markson | 160/135 X |
| 3,871,435 | 3/1975 | Lopatka | 160/135 |
| 4,034,463 | 7/1977 | Ryan | 52/239 X |
| 4,055,373 | 10/1977 | Andresen et al. | 312/263 |
| 4,090,335 | 5/1978 | Curatolo | 52/239 |
| 4,118,903 | 10/1978 | Coulthard | 52/36 |
| 4,166,332 | 9/1979 | Donovan | 160/135 X |
| 4,597,231 | 7/1986 | Quest | 52/239 |
| 4,914,873 | 4/1990 | Newhouse | 52/36 |
| 5,069,011 | 12/1991 | Jenne | 160/135 X |
| 5,097,643 | 3/1992 | Wittler | 52/238.1 |
| 5,328,260 | 7/1994 | Beirise | 312/223.6 |
| 5,651,219 | 7/1997 | Baloga et al. | 52/32 |
| 5,689,926 | 11/1997 | Nichols | 52/282.2 |
| 5,694,881 | 12/1997 | Creech | 116/222 |
| 5,737,887 | 4/1998 | Smeenge | 160/135 X |
| 5,803,146 | 9/1998 | Boon | 160/135 |

*Primary Examiner*—David M. Purol
*Attorney, Agent, or Firm*—Foley & Lardner

[57] ABSTRACT

A mobile screen having a "T"-shape for use on a ground surface is disclosed. The screen includes a base section having at least one panel providing a first surface having a first surface treatment and a second surface having a second surface treatment. The screen may also include an end section having at least one panel providing a first surface having a first surface treatment and a second surface having a second surface treatment. The base section is rigidly coupled to the end section to form the "T"-shape. At least one surface treatment of the base section or the end section is a functional surface treatment intended to selectively provide for the display of information. The screen may include a base section having a vertical frame member and at least one base panel extending therefrom and an end section having a pair of vertical frame members with at least one end panel extending therebetween. The mobile screen may also be provided with a handle or a tray. An apparatus for use in a work environment providing at least one work space is also disclosed. The apparatus may include at least one mobile screen having at least one panel adapted to display information. The mobile screen may be movable between a first arrangement wherein the work space is formed into at least one work area and at least one second arrangement wherein the work space is formed into at least two work areas. The mobile screen may be provided with casters.

50 Claims, 11 Drawing Sheets

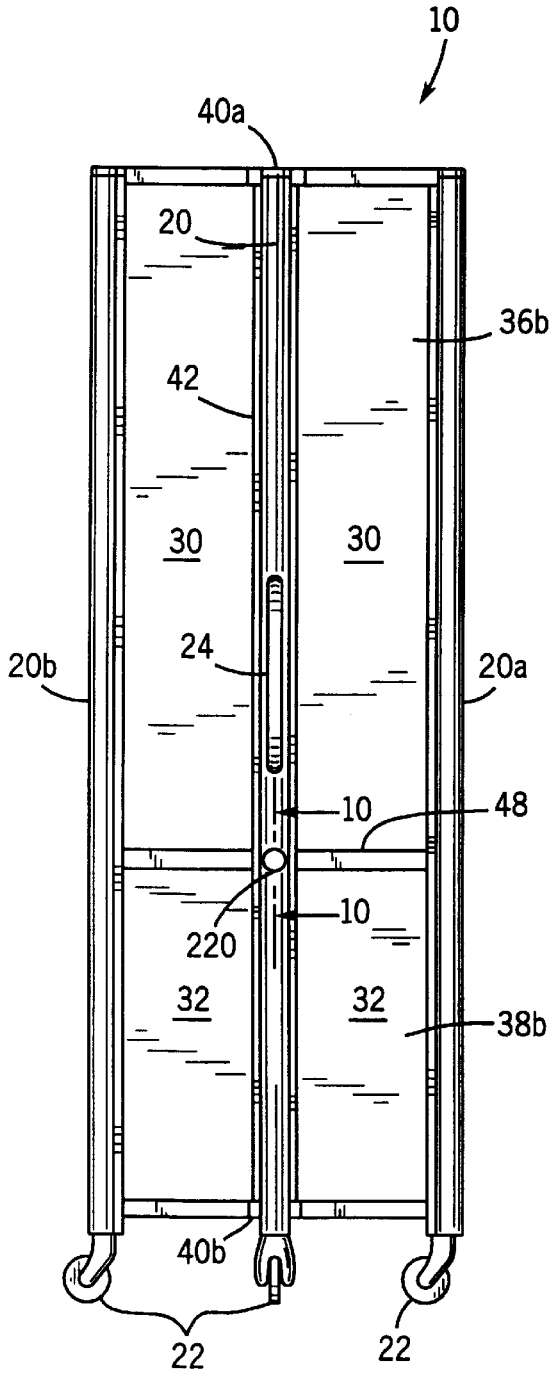
FIG. 2
FIG. 5
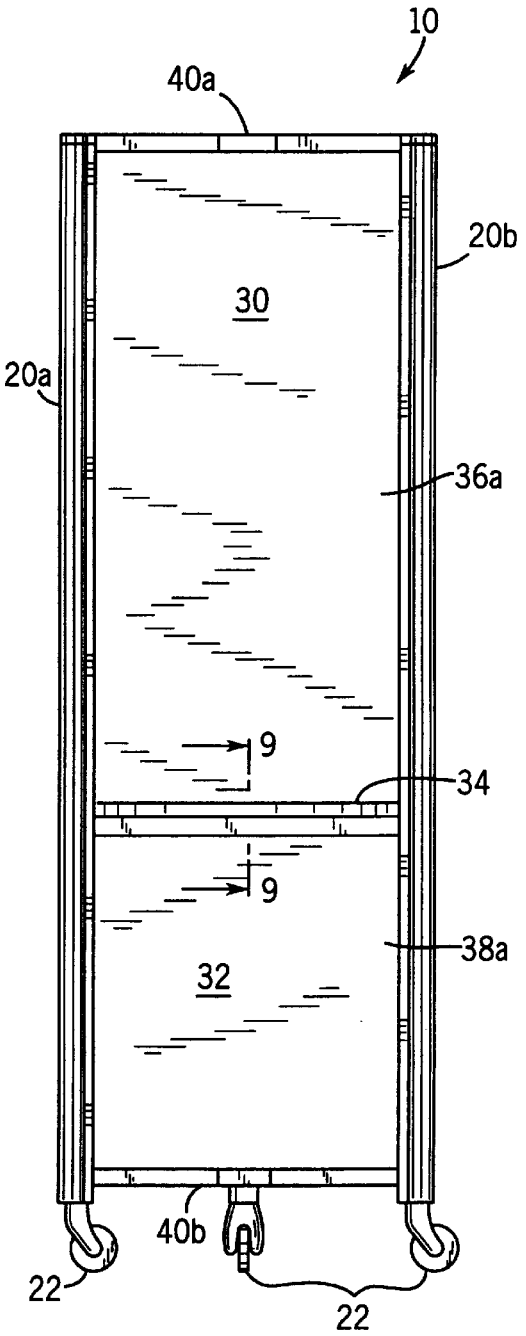

FIG. 3
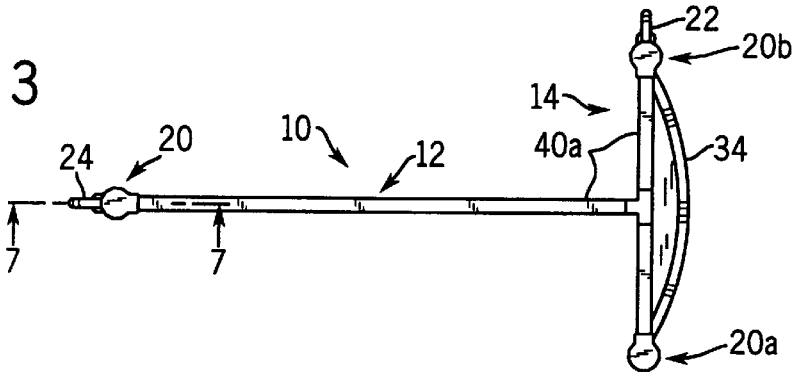
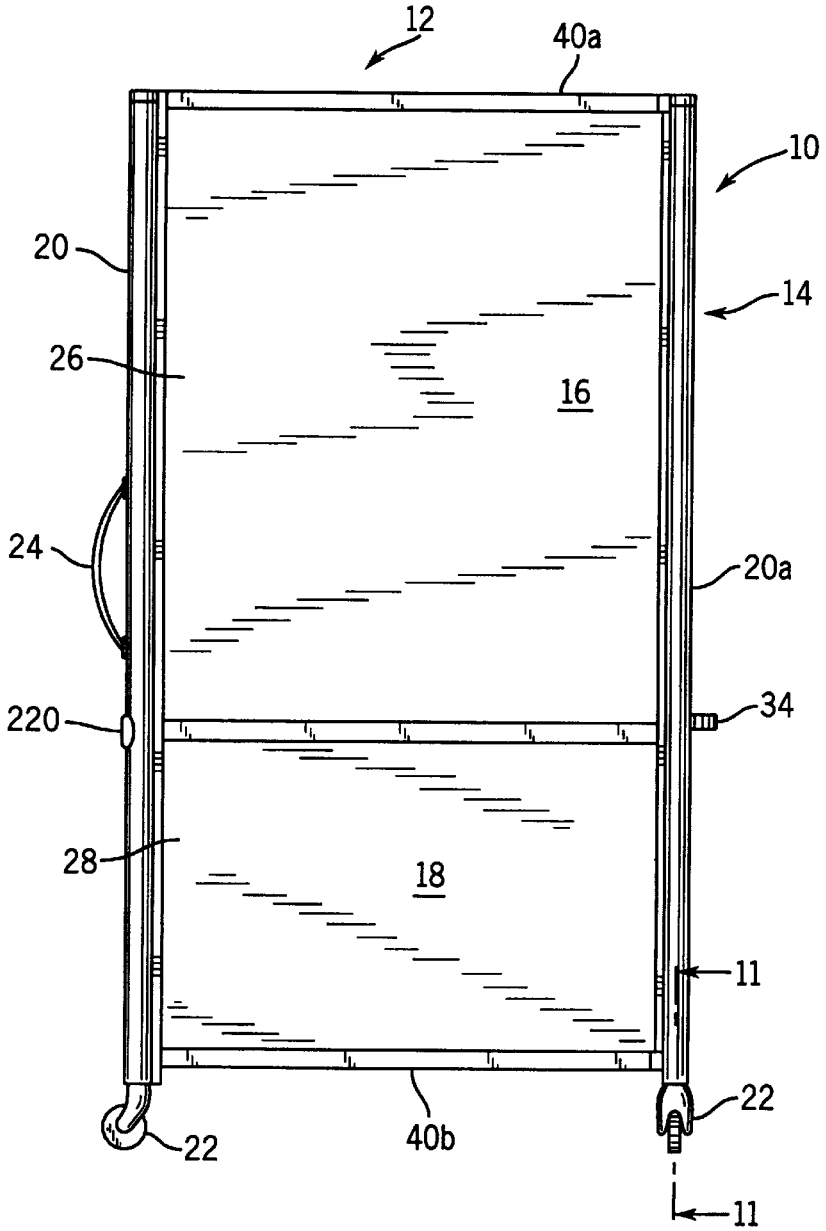
FIG. 4

FIG. 10
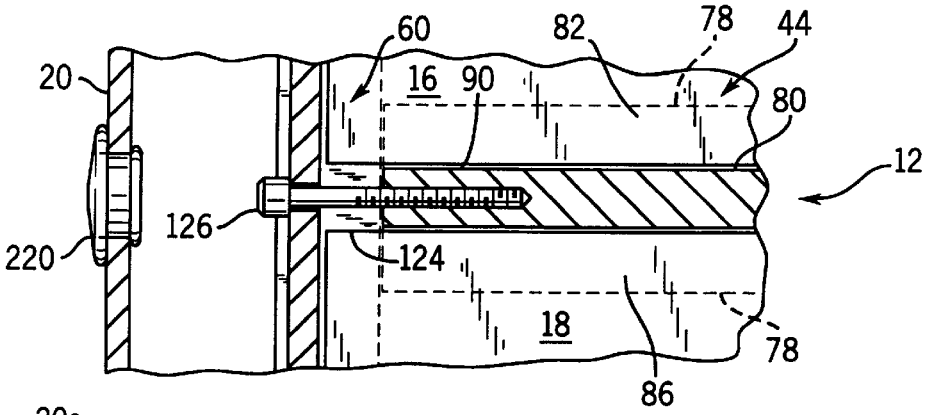
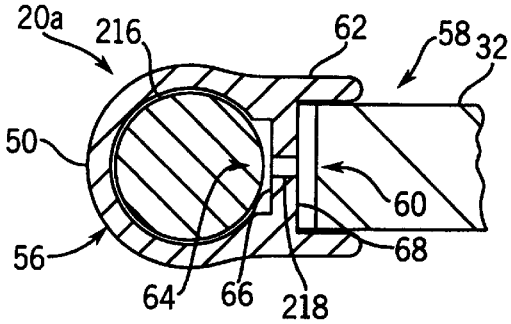
FIG. 12
FIG. 13
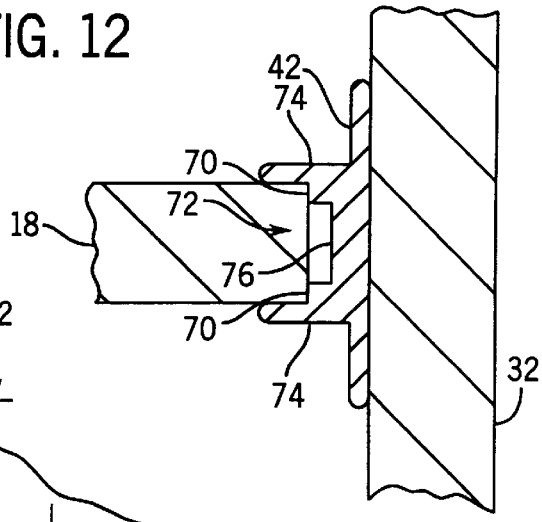
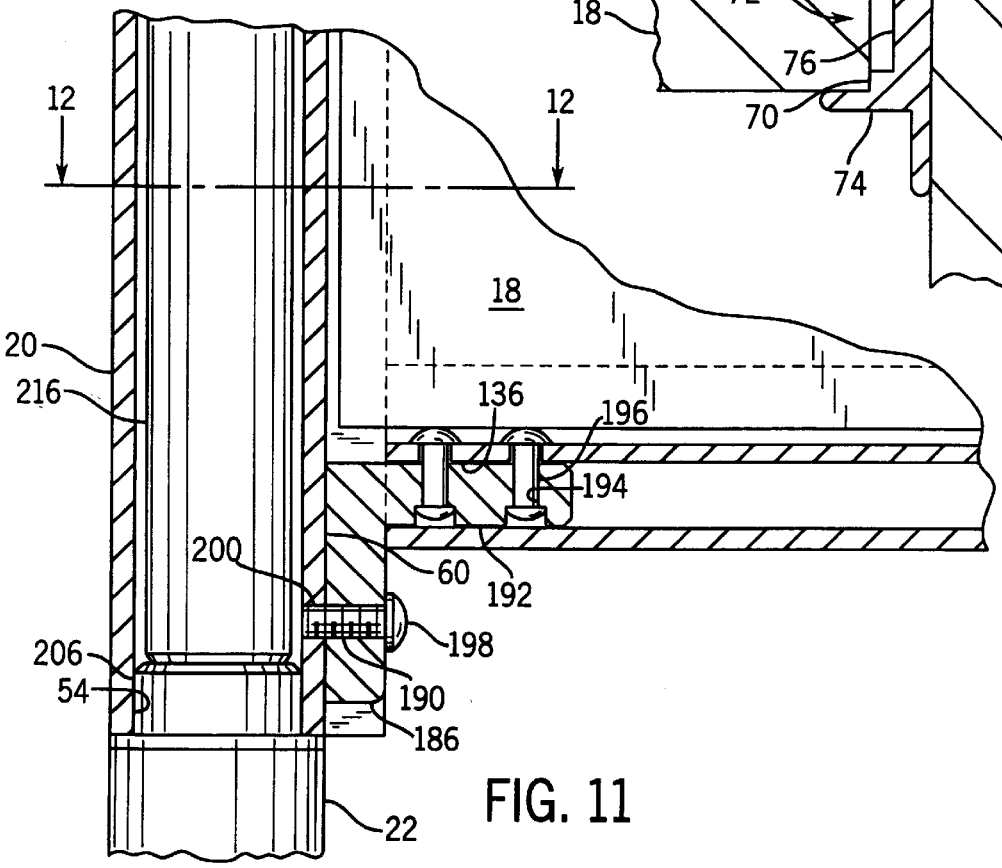
FIG. 11

MOBILE SCREEN

FIELD OF THE INVENTION

The present invention generally relates to a mobile screen adapted for use within a work environment.

CROSS-REFERENCE TO RELATED APPLICATIONS

The following U.S. patent applications are cited by reference and incorporated by reference herein: (a) Ser. No. 29/096,803, titled "SCREEN" filed Nov. 30, 1998; and (b) Ser. No. 09/197,090, titled "SEATING PRODUCT" filed Nov. 30, 1998; and (c) Ser. No. 29/096,841, titled "SEATING PRODUCT" filed Nov. 30, 1998; and (d) Ser. No. 09/197,180, titled "STORAGE UNIT" filed Nov. 30, 1998.

BACKGROUND OF THE INVENTION

It is known to provide for a partition or screen to provide physical space division or visual privacy in a work environment. For example, partition wall arrangements are well-known for use in a work environment to form work spaces and work areas configured to support individual workers or groups of workers in a variety of activities. Such known partition wall arrangements are typically associated with articles of furniture, such as worksurfaces, tables, chairs, storage units, and the like, to support the workers in their activities. Such known partition wall arrangements may include functional and decorative panels. However, according to such known partition wall arrangements, once the partition walls are installed, they effectively "define" the work environment and associated work spaces in a semi-permanent manner; it is not readily possible with such known partition wall arrangements for the workers themselves to reconfigure the work environment. As a result, such known partition wall arrangements are not typically well-suited for use in a dynamic work environment, where it is desirable for the workers themselves to have the ability to reconfigure work spaces as required by their particular activity at a given time.

It is also known to use a portable screen to provide visual privacy in a work environment. Known portable screens are typically floorstanding and characterized by a lightweight construction. Such known portable screens may have folding panel sections or may be made of one or more rigidly connected panel sections. Such known portable screens come in a variety of sizes, shades and forms and generally serve the function of providing visual privacy in a work environment or the like. (Other portable screens may be mounted on work surfaces, but serve the same purpose.) However, due to the construction of such known portable screens, they are typically not capable of serving a function other than providing visual privacy. Moreover, such known portable screens (although "mobile" perhaps) are typically not designed for convenient storage or association with other articles of furniture within the work environment. For example, known portable screens typically have legs extending outward from their profile, which may pose a risk of tripping persons walking by. Furthermore, such known portable screens generally must either strike a compromise between weight and maneuverability and strength and sturdiness. Further, such known portable screens are not adapted to use a variety of functional or decorative panels.

Accordingly, it would be advantageous to provide a mobile screen for use in a work environment that is highly maneuverable, yet sturdy. It would also be advantageous to provide for a mobile screen of a modular construction that can include any of a variety of functional or decorative panels or panel sections. It would further be advantageous to provide for a mobile screen that is well-suited for association with articles of furniture (whether in use or stowed) and that can readily be used to form work spaces of a variety of sizes and configurations (for visual privacy or for space division) as may be called for within a work environment. It would further be advantageous to provide for a mobile screen presenting these and other combinations of features not generally available in existing partition wall arrangements or portable screens, intended to support the activities of workers in a dynamic work environment. It would further be advantageous to have a mobile screen that is self-supported and has a relatively compact profile.

SUMMARY OF THE INVENTION

The present invention relates to a mobile screen having a "T"-shape for use on a surface. The mobile screen includes a base section having at least one panel providing a first surface having a first surface treatment and a second surface having a second surface treatment. The mobile screen also includes an end section having at least one panel providing a first surface having a first surface treatment and a second surface having a second surface treatment. The base section is rigidly coupled to the end section to form the "T"-shape. At least one surface treatment of the base section or the end section is a functional surface treatment intended to selectively provide for the display of information.

The present invention also relates to an apparatus for use in a work environment providing at least one work space. The apparatus includes at least one mobile screen having at least one panel adapted to display information and being movable between a first arrangement wherein the work space is formed into at least one work area and at least one second arrangement wherein the work space is formed into at least two work areas.

The present invention further relates to a mobile screen having a "T"-shape. The mobile screen includes a base section having a vertical frame member and at least one base panel extending therefrom to provide a first surface having a first surface treatment and a second surface having a second surface treatment. The mobile screen also has an end section having a pair of vertical frame members with at least one end panel extending therebetween to provide a first surface having a first surface treatment and a second surface having a second surface treatment. The base section is rigidly coupled to the end section to form the "T"-shape. At least one surface treatment of the base panel of the base section or the end panel of the end section is a functional surface treatment intended to provide for the display of information.

The present invention further relates to a mobile screen. The mobile screen includes a base section having a first side edge and a second side edge and an end section having a first side edge and a second side edge. The second side edge of the base section is connected to the end section at a point between the first and second side edges of the end section. A handle is connected to the base section.

DESCRIPTION OF THE FIGURES

FIG. 2 is a front elevation view of the mobile screen.

FIG. 3 is a top plan view of the mobile screen.

FIG. 4 is a side elevation view of the mobile screen.

FIG. 5 is a rear elevation view of the mobile screen.

FIG. 10 is a sectional view of the mobile screen taken along line 10—10 in FIG. 2.

FIG. 11 is a sectional view of the mobile screen taken along line 11—11 in FIG. 4.

FIG. 12 is a sectional view of the mobile screen taken along line 12—12 in FIG. 11.

FIG. 13 is a sectional view of the mobile screen taken along line 13—13 in FIG. 9.

DETAILED DESCRIPTION OF THE PREFERRED EMBODIMENTS

Figure 1A:
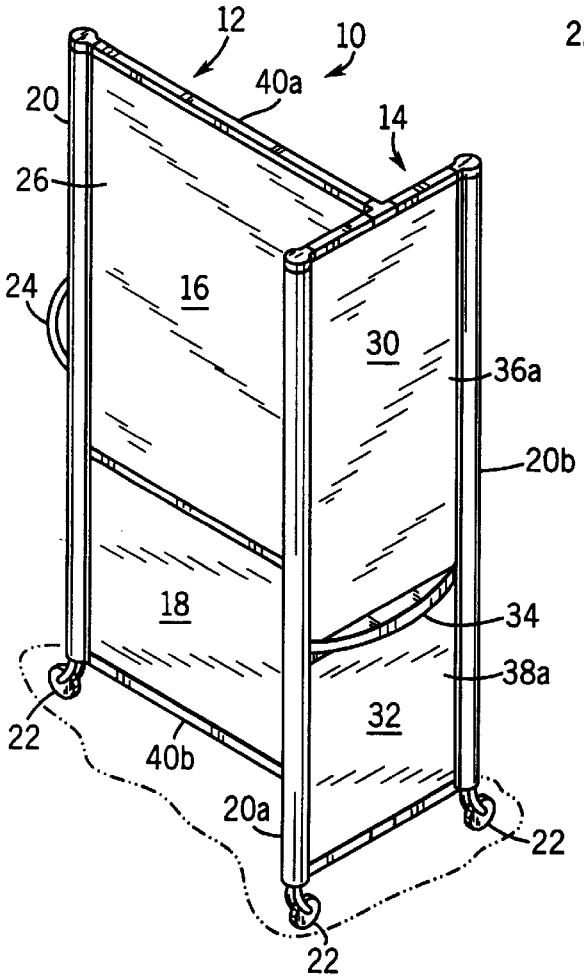
FIGS. 1A and 1B are perspective views of a mobile screen according to an exemplary embodiment of the present invention.
Figure 1B:
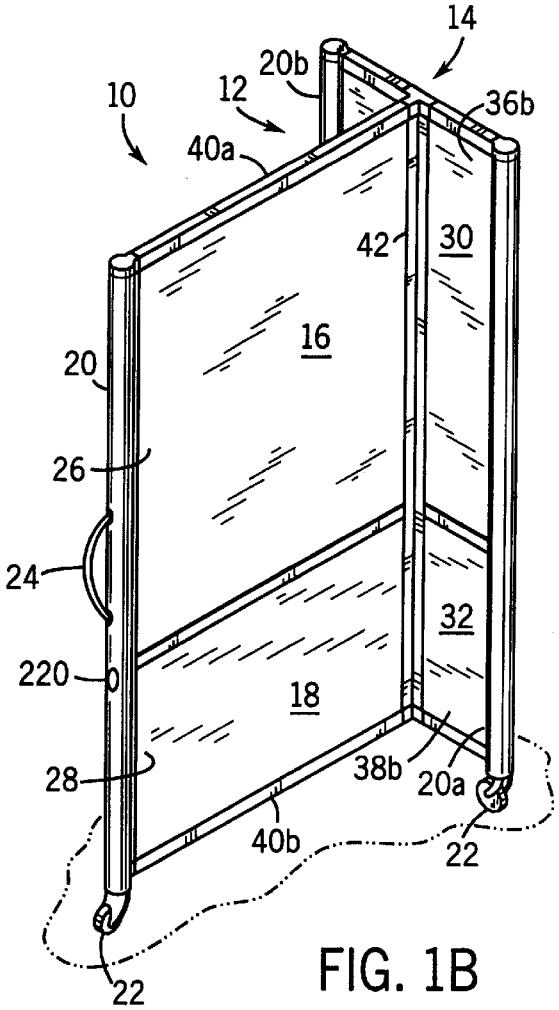

Referring to FIGS. 1A through 5, a mobile screen 10 is shown according to a preferred embodiment of the present invention. Mobile screen 10 has a "T" shape formed by joining of a base section 12 (a first vertical section) and an end section 14 (a second vertical section).

Base section 12 includes a top panel 16 and a bottom panel 18 extending from a vertical frame member 20 (shown as an generally tubular aluminum extrusion). A caster 22 is provided at the bottom of vertical frame member 20. A handle 24 is joined to vertical frame member 20. As shown, top panel 16 provides two exposed surfaces 26; bottom panel 18 provides two exposed surfaces 28.

End section 14 includes a top panel 30 and a bottom panel 32 extending between vertical frame members 20*a* and 20*b*. Caster 22 is provided at the bottom of each of vertical frame members 20*a* and 20*b*. A tray 34 extends between vertical frame members 20*a* and 20*b*. As shown, top panel 30 provides two exposed surfaces 36*a* and 36*b*; bottom panel 32 provides two exposed surfaces 38*a* and 38*b*. Surfaces 36*b* and 38*b* of top panel 30 and bottom panel 32, respectively, are vertically bisected by base section 12.

Mobile screen 10 also includes a top "T"-frame 40*a* and a bottom "T"-frame 40*b*. Top "T"-frame 40*a* secures vertical frame member 20 and top panel 16 of base section 12 to vertical frame members 20*a* and 20*b* and top panel 30 of end section 14. Bottom "T"-frame 40*b* secures vertical frame member 20 and bottom panel 18 of base section 12 to vertical frame members 20*a* and 20*b* and to bottom panel 32 of end section 14.

Figure 6:
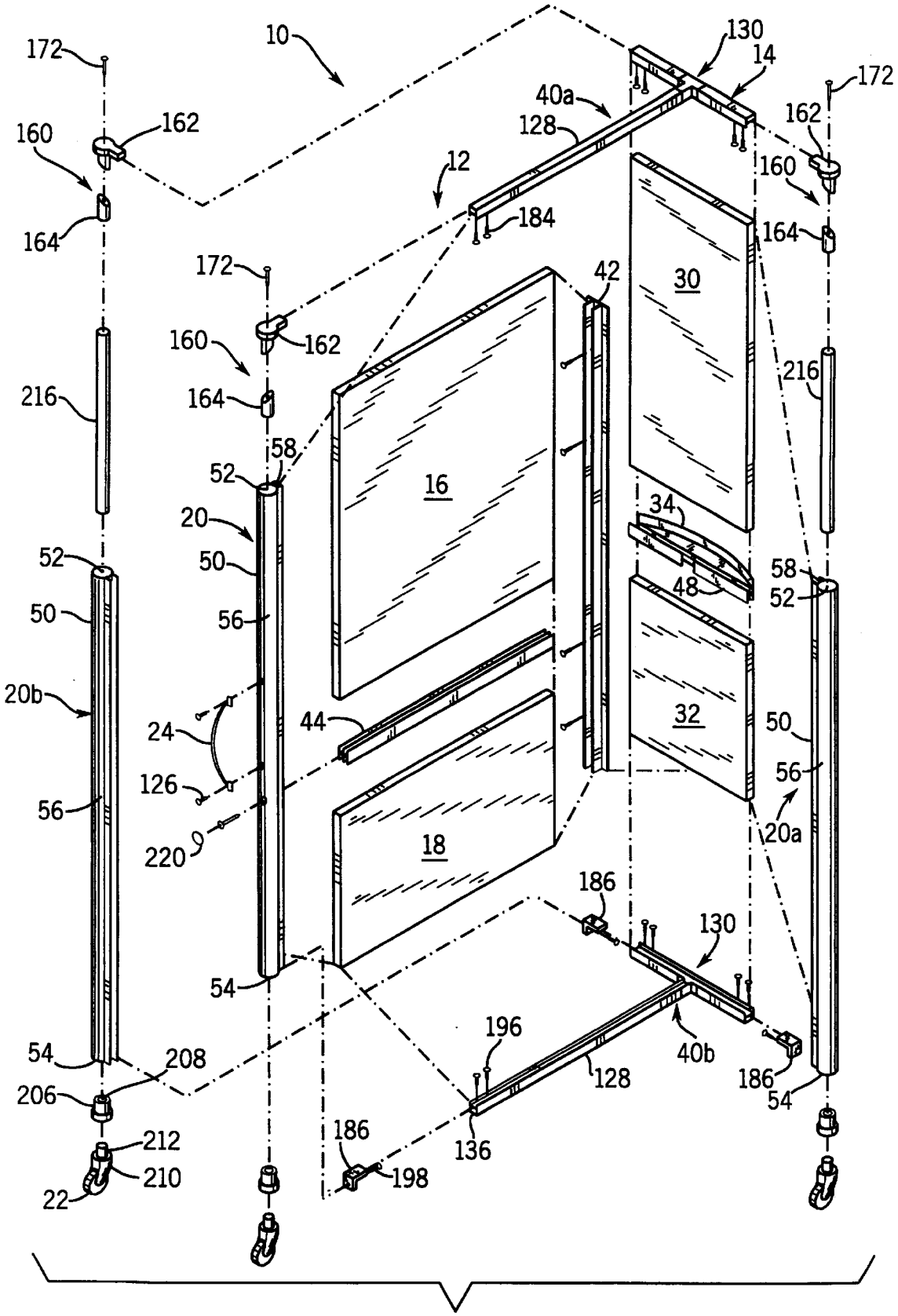
FIG. 6 is an exploded perspective view of the mobile screen.

Referring to FIGS. 6 through 13, the construction of mobile screen 10 is shown according to a particularly preferred embodiment. FIG. 6 is an exploded view of mobile screen 10 showing the basic arrangement of elements and sub-assemblies of base section 12 and end section 14.

Top panel 16 of base section 12 is installed between vertical frame member 20 and a vertical frame piece 42 (shown as an aluminum corner extrusion), and between a base frame member 128 of top "T"-frame 40*a* and a horizontal frame piece 44 (shown as an aluminum "tie fighter" extrusion). Bottom panel 18 of base section 12 is installed between vertical frame member 20 and vertical frame piece 42, and between a base frame member 128 of bottom "T"-frame 40*b* and horizontal frame piece 44.

Top panel 30 of end section 14 is installed between vertical frame members 20*a* and 20*b*, and between an end frame assembly 46 of top "T"-frame 40*a* and a horizontal frame piece 48 (shown as an aluminum "tie fighter" extrusion). Bottom panel 32 of end section 14 is installed between vertical frame members 20*a* and 20*b*, and between an end frame assembly 130 of bottom "T"-frame 40*b* and horizontal frame piece 48.

As shown in FIG. 6, each vertical frame member 20, 20*a* and 20*b* has a hollow tube portion 50 with a top opening 52 and a bottom opening 54 and providing a rounded exterior surface 56. Each vertical frame member 20, 20*a* and 20*b* also has a mounting portion 58 providing an exterior groove 60 (between two opposed projecting tabs 62) and an interior groove 64 (with a flat wall 66) separated by a web 68, as shown in FIG. 12. According to a particularly preferred embodiment, the vertical frame members are made as an extrusion of an industrial grade aluminum. Vertical frame number 20 has a front aperture allowing for access to a coaxial aperture (e.g. threaded aperture). A plastic cover cap 220 can be snap fit into the front aperture; cover cap 220 can display a logo or other such information. Handle 24 is attached to vertical frame member 20 by threaded fasteners.

As shown in FIGS. 6 and 13, vertical frame piece 42 has a base 70 providing a base surface opposite a central groove 72 (between two opposed projecting tabs 74); central groove 72 (for seating top panel 30 or bottom panel 32 of base section 12) includes a notch 76. (According to a particularly preferred embodiment, the frame piece is an aluminum extrusion.)

Referring to FIGS. 6, 6C, 9 and 10, horizontal frame piece 44 of base section 12 provides a pair of outer walls 78 joined by a web 80 to provide an upper groove 82 (with a central fin 84) and a lower groove 86 (with a central fin 88); at each end of horizontal frame piece 44, web 80 includes a threaded boss 90. (According to a particularly preferred embodiment, the frame piece is an aluminum extrusion.)

Figure 6A:
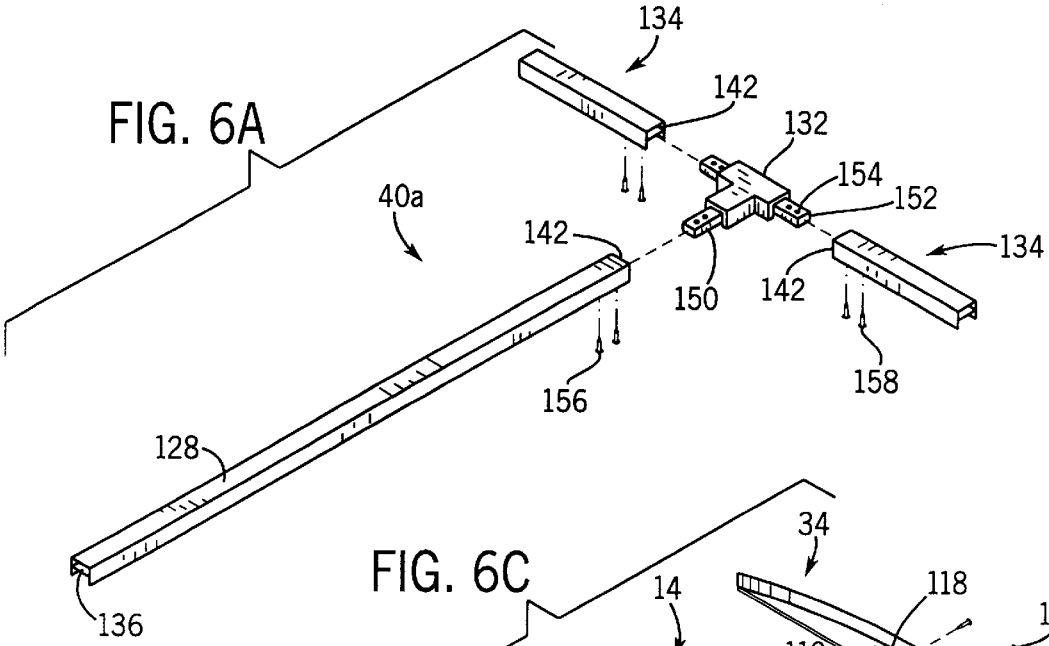
FIGS. 6A through 6C are fragmentary exploded perspective views of the mobile screen.
Figure 6C:
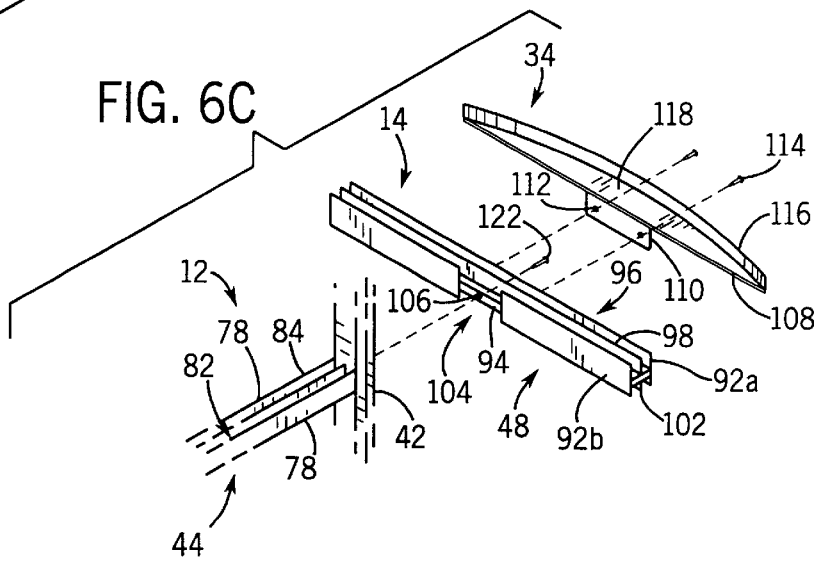
Figure 9:
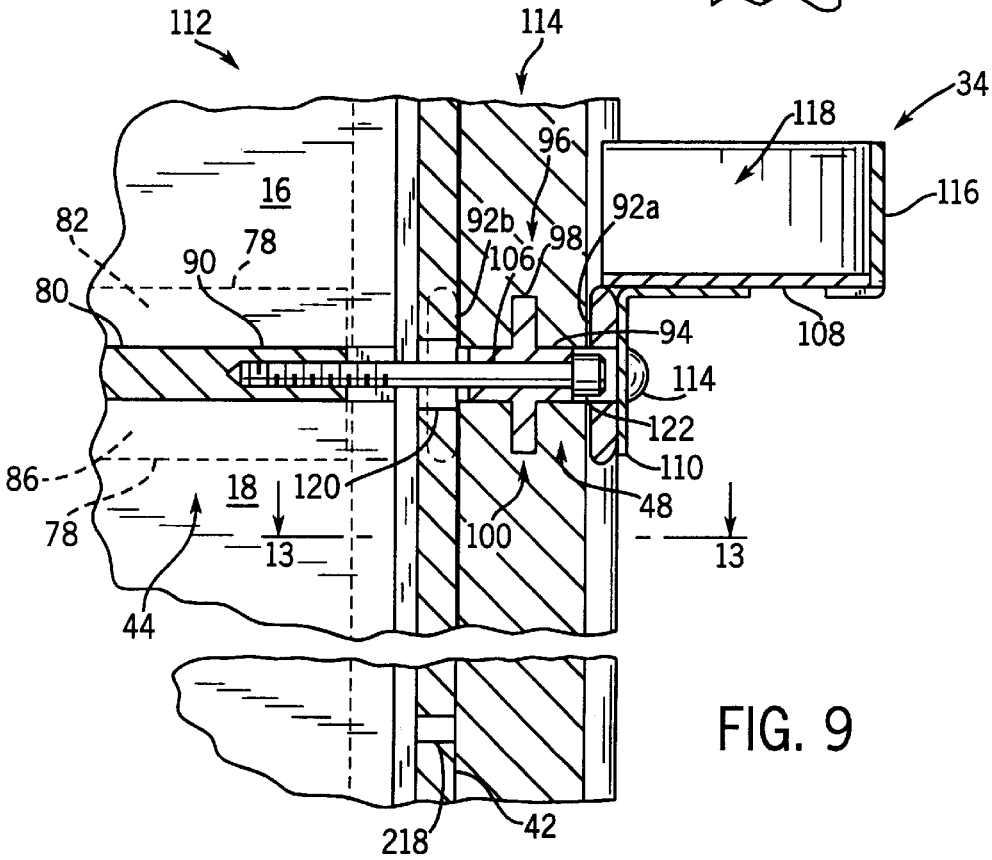
FIG. 9 is a sectional view of the mobile screen taken along line 9—9 in FIG. 5.

Referring to FIGS. 6 and 6C, and 9, horizontal frame piece 48 of end section 14 provides a pair of outer walls 92*a* and 92*b* joined by a web 94 to provide an upper groove 96 (with a central fin 98) and a lower groove 100 (with a central fin 102). (According to a particularly preferred embodiment, the frame piece is an aluminum extrusion.) A gap 104 in outer wall 92*b* provides a mounting area for vertical frame piece 42. A central aperture 106 is provided transversely through web 94. A pair of lateral threaded apertures (not visible in FIG. 6C) are provided for mounting of tray 34 to horizontal frame piece 48 of end section 14 (e.g. in a cantilevered arrangement). Tray 34 has a flat base 108 coupled to a mounting bracket 110 having two corresponding apertures 112 for threaded fasteners 114. Tray 34 has a curved front piece 116 forming with flat base 108 an open receptacle 118 (e.g. for storage of markers, erasers, push-pins, etc.). According to an particularly preferred embodiment, the tray is made of a metal material.

As shown in FIG. 9, horizontal frame piece 44 of base section 12 is secured at one end through an aperture 120 in vertical frame piece 42 and aperture 106 in horizontal frame piece 48 of end section 14 by a threaded fastener 122 threaded into boss 90. As shown in FIG. 10, horizontal frame piece 44 of base section 12 is secured at the other end through an aperture 124 (and into exterior groove 60) of vertical frame member 20 by a threaded fastener 126 threaded into boss 90. When fasteners 122 and 126 are tightened, vertical frame member 20 is drawn towards horizontal frame piece 48 of end section 14, drawing top panel 16 and bottom panel 18 into grooves 60 and 72 in vertical frame member 20 and vertical frame piece 42, respectively. Base 70 of vertical frame piece 42 is drawn towards top panel 16 and bottom panel 18 of base section 12.

Figure 6B:
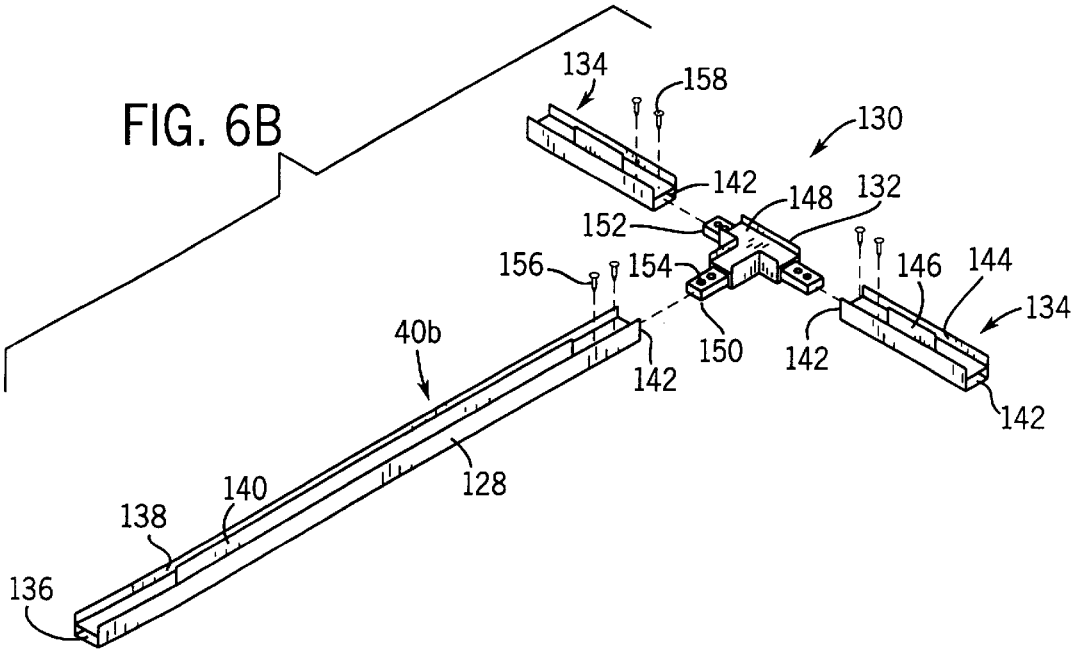
Figure 7:
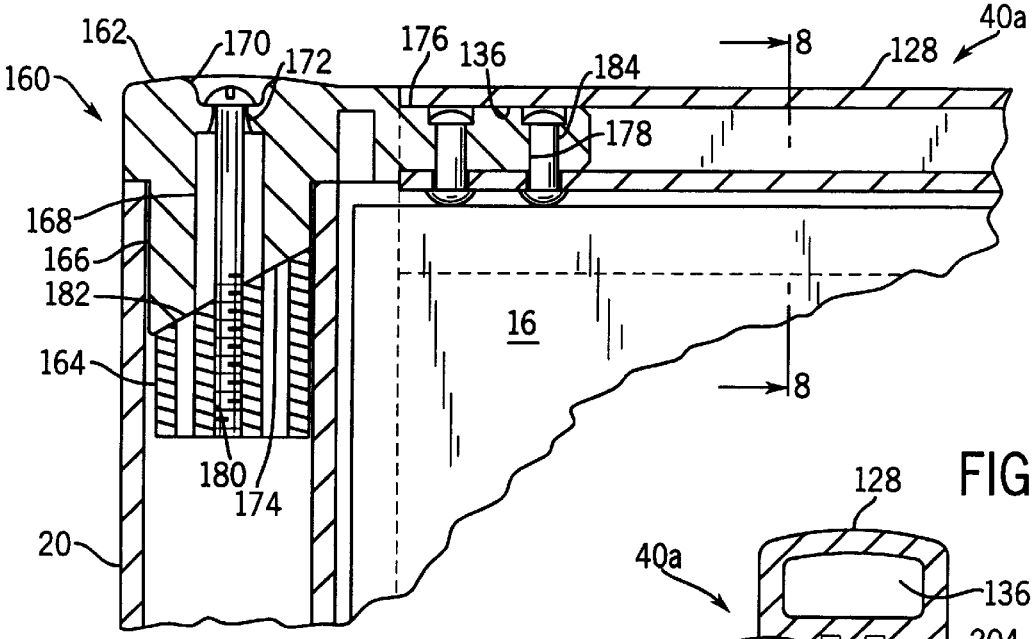
FIG. 7 is a sectional view of the mobile screen taken along line 7—7 in FIG. 3.

As shown in FIGS. 6A and 6B, top and bottom "T"-frames 40*a* and 40*b* have similar constructions. Each "T"-frame 40*a* and 40*b* has a base frame member 128 (e.g. an extrusion) and an end frame assembly 130. End frame assembly 130 includes a "T"-connector 132 and two end frame members 134 (e.g. extrusions). Each base frame member 128 is provided with a recess 136 having a rectangular profile and a groove 138 (with a partial central fin 140) (see also FIGS. 7 and 8). End frame members 134 are each provided with a recess 142 having a rectangular profile and a groove 144 (with a partial central fin 146). "T"-connector 132 includes a "T"-shaped groove 148 (e.g. forming a junction matching the profile of grooves 138 and 144) and provides a central tab 150 and a pair of lateral tabs 152; each tab 150 and 152 has two threaded apertures 154. As shown, central tab 150 of "T"-connector 132 is inserted into recess 142 of base frame member 128 and secured by two threaded fasteners 156; each lateral tab 152 is inserted into recess 142 of corresponding end frame member 134 and secured by two threaded fasteners 158. (Epoxy can be used to strengthen the assembly.) According to any preferred embodiment, the top and bottom "T"-frames each provide a generally rigid structure. As shown in FIGS. 6 and 7, end connectors 160 having a cap 162 and a wedge 164 are used to secure top "T"-frame 40*a* to vertical frame members 20, 20*a* and 20*b*. Cap 162 includes a base 166 with a central aperture 168 (with a countersink 170) into which a shoulder screw 172 is inserted and has a beveled bottom surface 174. Cap 162 also includes a tab 176 having two apertures 178. Wedge 164 includes an offset threaded aperture 180 into which shoulder screw 172 can be threaded and has a beveled top surface 182 (that mates with beveled bottom surface 174 of cap 162). As shown, tab 176 of cap 162 is inserted into recess 136 of base frame member 128 of "T"-frame 40*a* and secured by two fasteners 184 (e.g. rivets). (Epoxy can be used to strengthen the assembly.) Base 166 of cap 162 and wedge 164 are inserted into top opening 52 of, for example, vertical frame member 20. The exterior surface of base 166 of cap 162 is sized to be tightly press-fit into top opening 52 of vertical frame member 20; when shoulder screw 172 is tightened, the exterior surface of the wedge 164 (and also the exterior surface of base 166 of cap 162) is further drawn into tight contact with the interior surface of the opening of vertical frame member 20, which creates a strong connection. As a result, as shown in FIG. 7, end connector 160 secures top "T"-frame 40*a* to vertical frame member 20. As indicated in FIG. 6, an end connector is used in this manner to secure top "T"-frame to vertical frame members at each of three locations. According to a particularly preferred embodiment, the cap and wedge of the end connector are made of a die cast zinc.

As shown in FIGS. 6 and 11, "L"-connectors 186 are used to secure bottom "T"-frame 40*b* to vertical frame members 20, 20*a* and 20*b*. "L"-connector 186 includes a base 188 with an aperture 190 and a tab 192 having two threaded apertures 194. As shown, tab 192 of "L"-connector 186 is inserted into recess 136 of base frame member 128 of "T"-frame 40*b* and secured by two fasteners 196 (e.g. rivets). (Epoxy can be used to strengthen the assembly.) Base 188 of "L"-connector 186 is mounted with a threaded fastener 198 extending through aperture 190 into a threaded aperture 200 within groove 60 on vertical frame member 20. As a result, as shown in FIG. 11, "L"-connector 186 secures bottom "T"-frame 40*b* to vertical frame member 20. (Epoxy can be used to strengthen the assembly.) As indicated in FIG. 6, an "L"-connector is used in this manner to secure bottom "T"-frame to vertical frame members at each of three locations.

Figure 8:
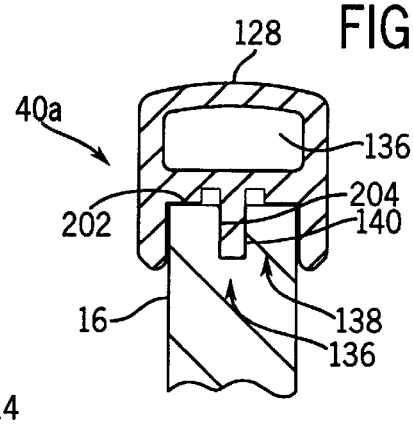
FIG. 8 is a sectional view of the mobile screen taken along line 8—8 in FIG. 7.

As shown in FIG. 8, top panel 16 is seated in groove 138 of base frame member 128 of "T"-frame 40*a*. As is also shown , a top edge 202 of top panel 16 may be provided with a machined groove 204 engaged by central fin 140 of base frame member 128 of "T"-frame 40*a* for secure engagement. According to alternative embodiments, for example as may depend upon the construction of the panel, the frame members and frame pieces may not be provided with fins. According to a preferred embodiment, the edges of the panel may be provided with an a supplemental trim piece (e.g. a trim piece with adhesive treatment such as two-sided tape at the lateral edges) or other treatment intended to enhance the degree of engagement of the edge of the panel within the groove of the frame members or frame pieces. According to any preferred embodiment, the frame members and frame pieces may be given a profile and dimension that is matched to the profile and dimension of the panels to be installed within the mobile screen to provide for a suitable degree of engagement.

As shown in FIGS. 3, 6 and 11, casters 22 are installed within a bottom opening 54 of each of vertical frame members 20, 20*a* and 20*b*. A caster insert 206 (shown as knurled caster insert having a central aperture 208) is tightly and securely press-fit into bottom opening 54 of vertical frame member 20. Caster 22 (shown as a locking caster with a shroud 210) includes a mounting pin 212 which is installed within central aperture 208 of caster insert 206 so that caster 22 is freely rotatable with respect to fixed caster insert 206 (and vertical frame member 20). According to any preferred embodiment, the casters installed within each of vertical frame members are of a conventional design and mounting arrangement, providing for free rolling movement along a surface (such as a floor) and free 360 degree rotation within the caster insert (or other caster assembly). According to a particularly preferred embodiment, each of the casters will include a brake that can be engaged to keep the mobile screen from rolling on the floor. Although a mobile screen having casters is disclosed, it should be recognized that according to an alternative embodiment, the mobile screen can be provided without casters, e.g. so that mobility is provided by lifting and carrying (or sliding) along the floor of the work environment, or by using any other structure or material that enhances mobility. According to any preferred embodiment, the mobile screen is self-supported and has a relatively compact profile.

As shown in FIG. 6, a relatively short rod 216 of a dense material (e.g. steel) may be inserted as ballast into each of vertical frame members 20*a* and 20*b* to add weight near the bottom of mobile screen 10 and thereby further stabilize mobile screen 10 against being inadvertently tipped over (e.g. while the mobile screen is pulled or pushed by the handle). Rods 216 may be secured within vertical frame members 20*a* and 20*b* near their bottoms by an adhesive (e.g. a heat activated adhesive). The adhesive may be injected into an annular gap existing between rods 216 and the inner surfaces of vertical frame members 20*a* and 20*b* through apertures 218 within walls of vertical frame members 20*a* and 20*b* as shown in FIG. 12.

As is shown in the FIGURES, the mobile screen may be provided in any of a wide variety of sizes and configurations. According to a particularly preferred embodiment of the mobile screen, the base section is provided in approximate lengths of 40 inches or 60 inches; the end section is provided in a length of 24 inches; the mobile screen is available in a variety of heights, including 54 inches, 66 inches and 75 inches. (These dimensions are approximate.) As will be apparent to those who review this disclosure, according to alternative embodiments, the mobile screen may be provided in other heights, or with the base section and end section having other lengths. As will also be apparent to those who review this disclosure, the base section and/or end section of the mobile screen each may be configured to include a greater or lesser number of panels (in a variety of sizes and shapes).

As shown in the FIGURES, each of the panels of the mobile screen and/or each of their respective surfaces can be provided with any of a variety of constructions or surface treatments (or finishes), serving functional and/or decorative purposes, in any of a variety of combinations. For example, the panels may be of any of a variety of functional constructions, such as whiteboard or markerboard (e.g. providing one or two surfaces having a conventional dry-erase surface treatment), tackboard (e.g. of a corkboard or like construction facilitating the attachment of paper sheets using fasteners such as push-pins), translucent or transparent (e.g. of a clear or other light-transmitting construction, possibly provided with a writable-erasable surface treatment). The panels may also be of any of a variety of decorative constructions, such as a wood veneer, plastic laminate, or metal, which may be arranged to provide a desired visual or ornamental effect. As will be apparent to those who review this disclosure, the panels of the mobile screen may have other constructions and/or surface effects and may be arranged in any of a wide variety of combinations within a particular mobile screen or within a set of mobile screens collectively intended for use in work environment. Any particularly preferred embodiment of the mobile screen will include functional panels intended to contain or display information (e.g. display rack, whiteboard, tackboard, corkboard, markerboard, posterboard, tablet, other writable surface or surface to which information in some form or media may be applied or shown).

According to any preferred embodiment, the mobile screen has a "modular" construction, with elements that are capable of assembly and arrangement in any of a variety of sizes, configurations and combinations, and suitable (e.g. functionally and decoratively) for use in a wide variety of work environments and in association with any of a wide variety of articles of furniture (such as panel wall systems, storage products, seating products, workstations, work surfaces, etc.).

Figure 14:
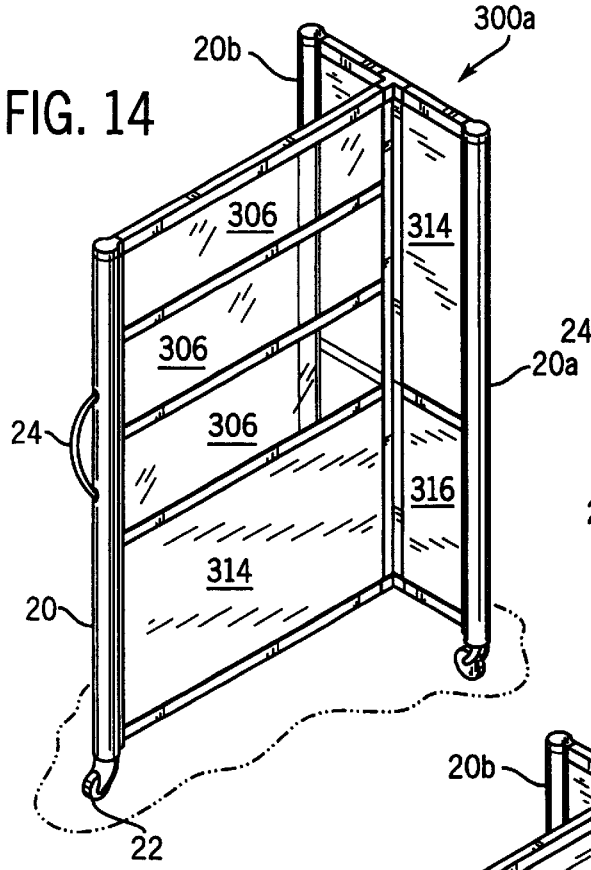
FIGS. 14 through 18 are perspective views of the mobile screen according to alternative embodiments.
Figure 15:
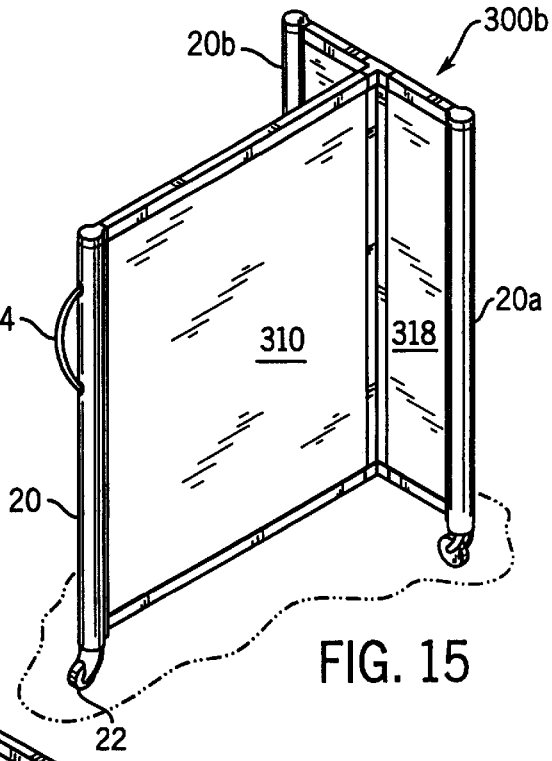
Figure 16:
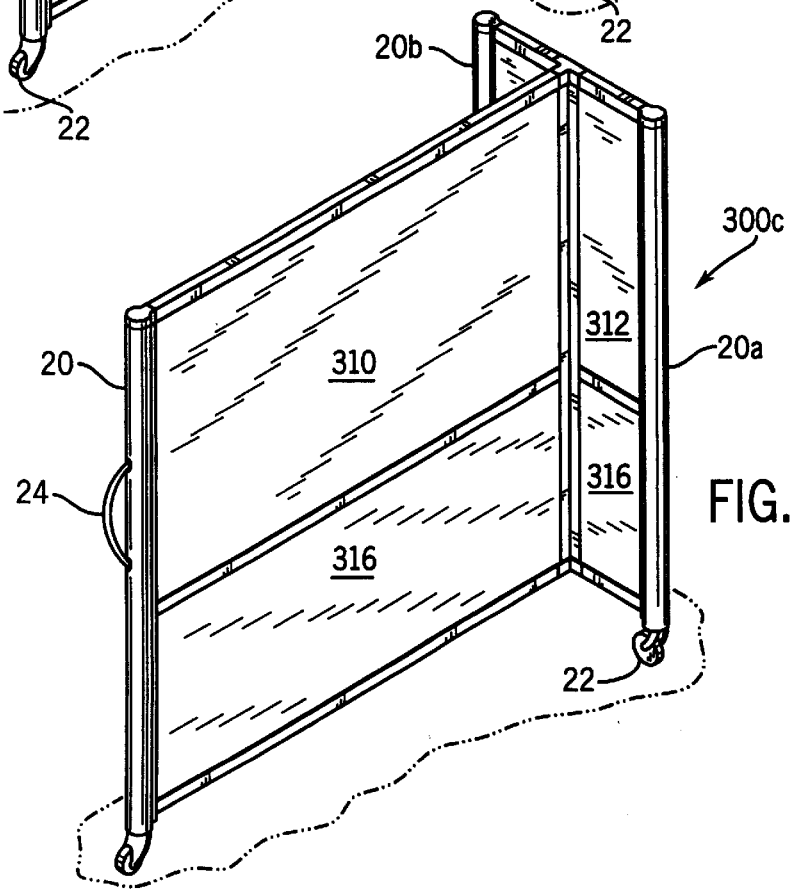
Figure 17:
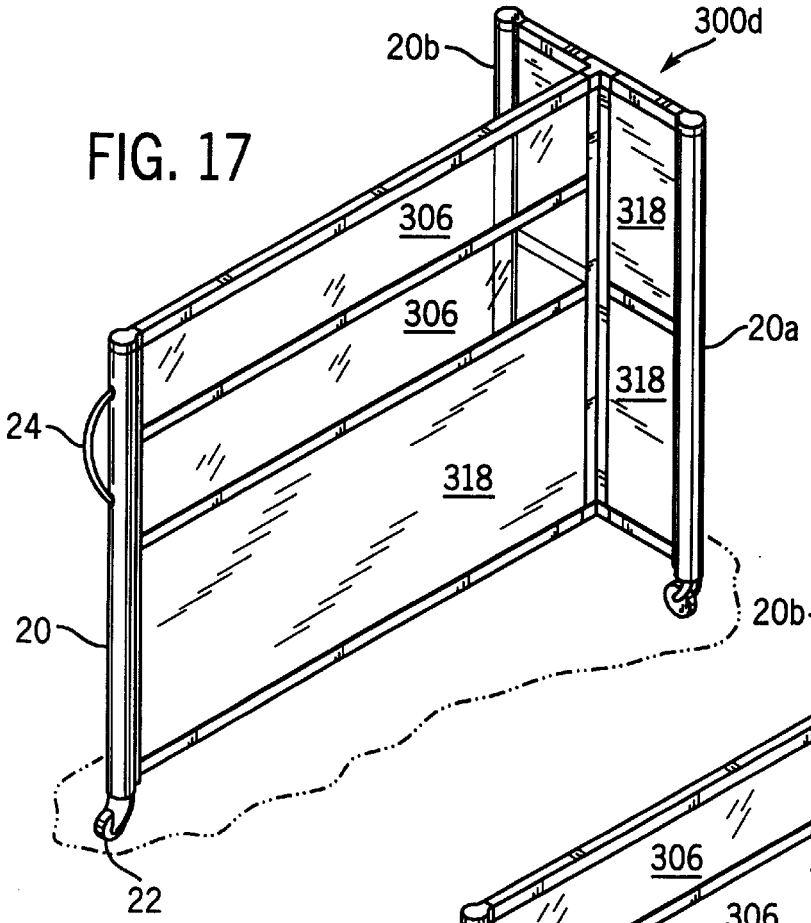
Figure 18:
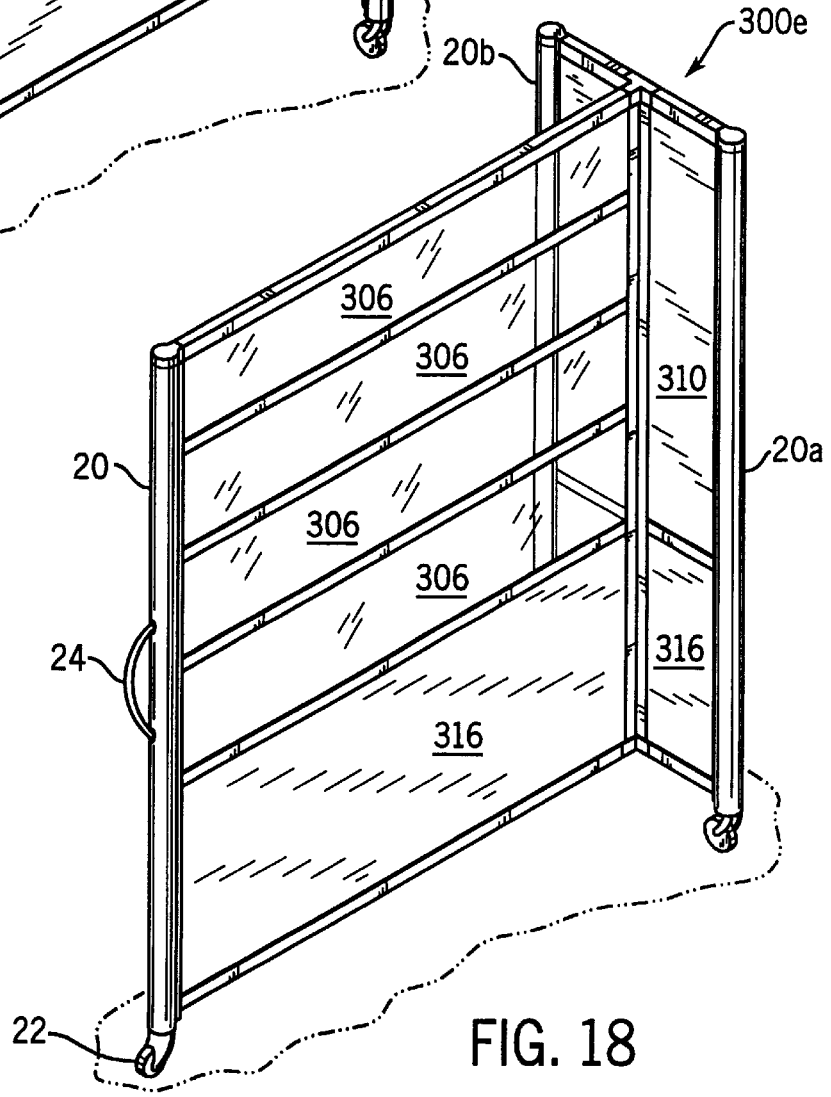

Referring to FIGS. 14 through 18, mobile screens are shown in a variety of sizes and configurations according to alternative embodiments. FIGS. 14, 17 and 18 show mobile screens 300*a*, 300*b* and 300*c* (of varying sizes) having a series of light-transmitting panels (e.g. transparent panels 306 or translucent panels 308 with their edges in a trim piece such as a PVC tube-strip). FIG. 15 shows a mobile screen 300*b* with a whiteboard panel 310. FIG. 16 shows a mobile screen 300*a* with a tackboard panel 312. As shown in FIGS. 17 and 18 of mobile screens 300*d* and 300*e*, other panel constructions such as wood veneer 314, plastic laminate 316, metal sheet 318 are equally suitable, and corkboard 319 may be provided.

Figure 19A:
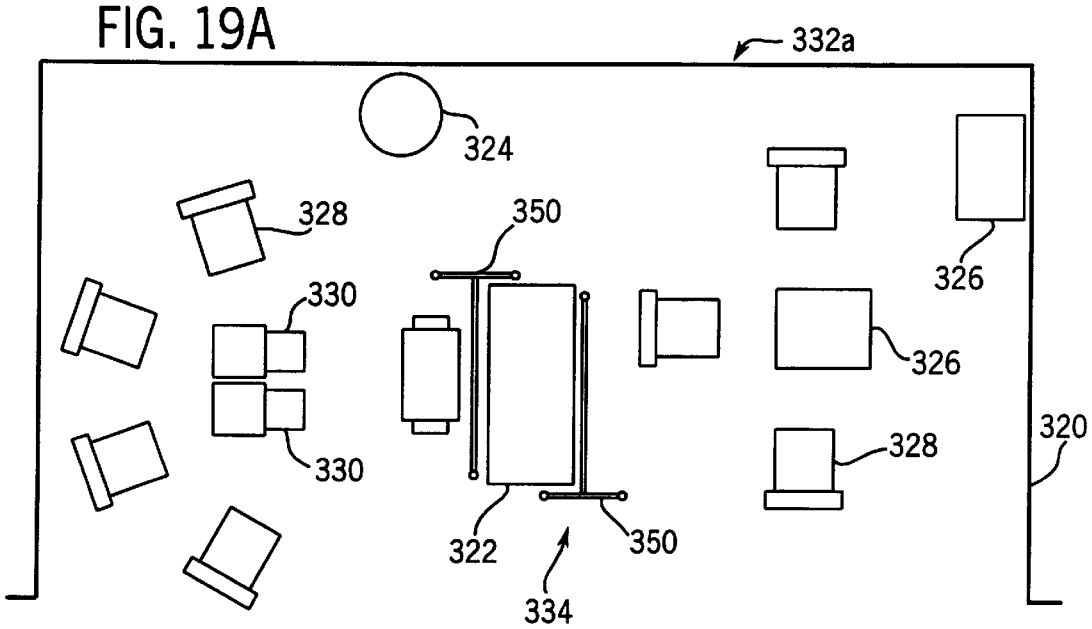
FIGS. 19A through 20B are top plan views of work environments showing association of mobile screens with other articles of furniture to form work areas within work spaces.
Figure 19B:
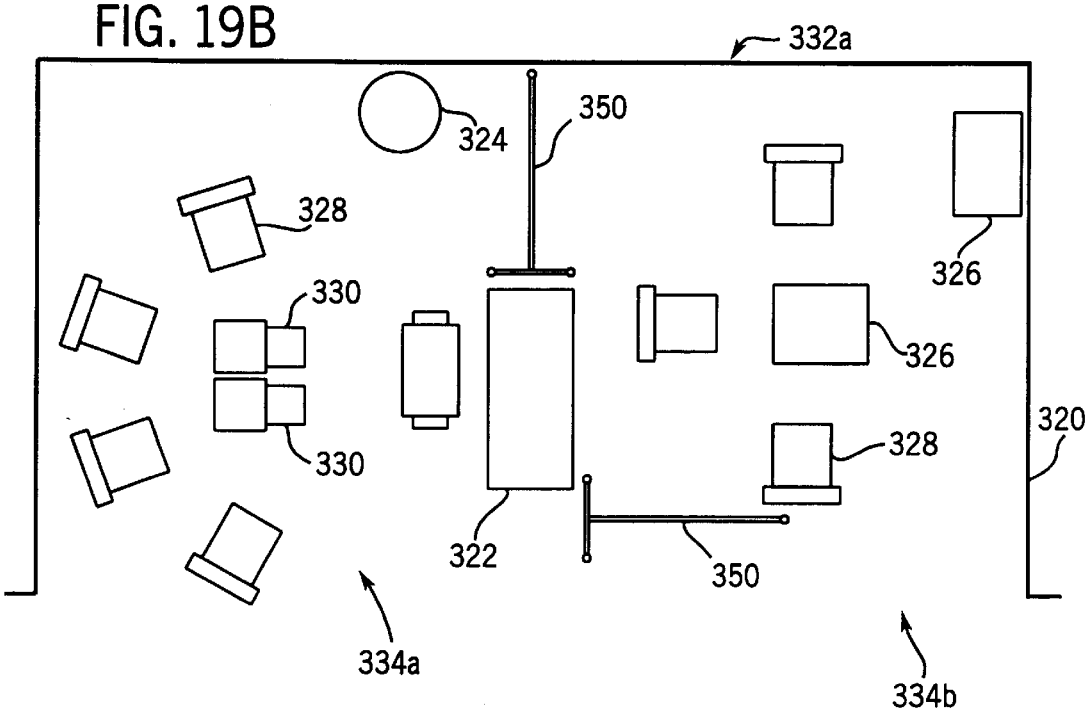

As shown in FIGS. 19A through 20B, according to any particularly preferred embodiment, the mobile screen is intended for use in a work environment. In FIGS. 19A and 19B, according to and exemplary embodiment, work environment 332*a* (partially defined by architectural walls 320) includes a storage unit 322 (intended to be representative of a type shown in pending U.S. patent application Ser. No. 09/197,18 filed Nov. 30, 1998, tables 324 and 326, seating products 328, mobile file units 330 and mobile screens 350. In FIG. 19A, mobile screens 350 are stowed adjacent to storage unit 322 (and as shown "fit" closely with the dimensions of storage unit 322); work environment 332*a* is arranged to provide an open work space 334. In FIG. 19B, mobile screens 350 have been deployed to (in association with storage unit 322) divide work environment 332*a* into two work spaces 334*a* and 334*b* (e.g. physically and visually divided work area for worker activity).

Figure 20A:
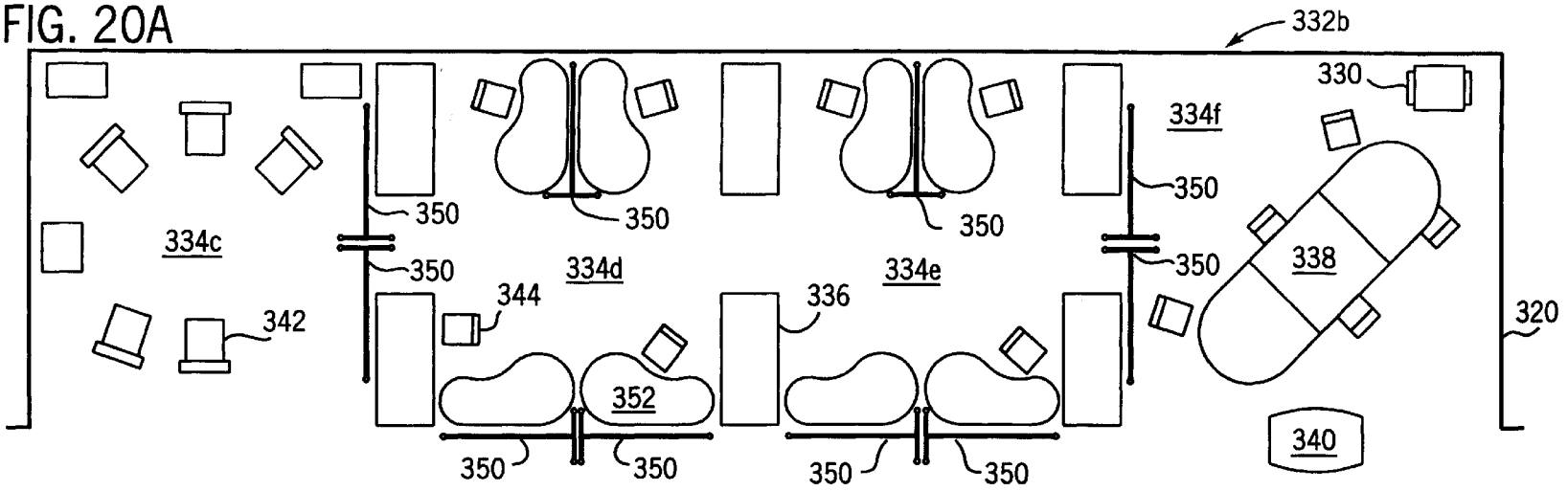
Figure 20B:
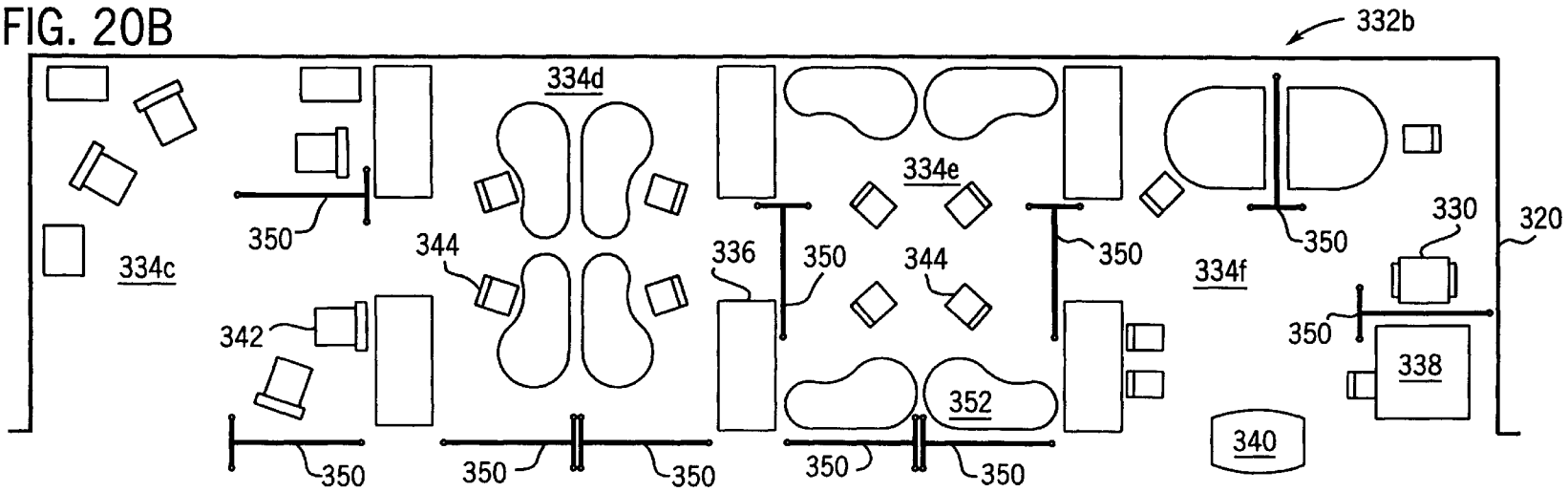

Referring to FIGS. 20A and 20B, a work environment 332*b* according to an exemplary embodiment (partially defined by architectural walls 320), is shown. Work environment 332*b* provides four work spaces 334*c*, 334*d*, 334*e* and 334*f*. Work environment 332*b* includes storage units 336, work surfaces 352, tables 338 and 340, chairs 342 and 344, mobile file units 330, and mobile screens 350. In FIG. 20A, work environment 332*b* is in a first condition where using mobile screens 350 (in association with other articles of furniture) work space 334*d* and work space 334*e* are jointly closed off (from work space 334*c* and work space 334*f*) to form a larger work area for worker activity. In FIG. 20B, work environment 332*b* is in a second condition where using mobile screens 350 (in association with other articles of furniture) work space 334*c* and work space 334*d* are jointly closed off (from work space 334*e* and work space 334*f*) to form another work area for worker activity. As is shown, the mobile screens may cooperate with other mobile articles of furniture (and "fixed" articles of furniture) to allow reconfiguration of work spaces, work areas and work stations for use by individual workers or groups of workers (who may be engaged in group, public, semi-private or private activities).

As will become apparent to those who review this disclosure, FIGS. 19A through 20B are schematic only and the nature or extent of the work space division effected by the mobile screens can be varied depending upon the height and width of the mobile screens or their number, as well as their arrangement and position (alone or in association with other articles of furniture of various heights and widths). The mobile screen may be associated with any type of article of furniture according to other exemplary embodiments, and may be provided with an ornamental appearance intended to fit or "match" with the ornamental appearance of one or more associated articles of furniture.

It is important to note that the use of the term "information" is meant to cover any use of any type of media or any type of representation that can be associated with a display panel, including but not limited to written, printed, paper sheets, electronic display, etc.

Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, or use of materials) without materially departing from the novel teachings and advantages of the invention. (According to a particularly preferred embodiment, the frame members and frame pieces of the mobile screen are aluminum extrusions, the handle is cast aluminum, the "T"-connector and the "L"-connector are die cast zinc, and the functional and decorative panels are constructed of materials available from commercial suppliers.) According to alternative embodiments, for example, the handle or tray may be provided in any of a variety of shapes, sizes and orientations, and may be mounted at any suitable location (e.g. frame member or panel) on the mobile screen. Accordingly, all such modifications are intended to be included within the scope of the invention as defined in the appended claims. Other substitutions, modifications, changes and omissions may be made in the design, operating conditions and arrangement of the preferred embodiments without departing from the spirit of the invention as expressed in the appended claims.

What is claimed is:

1. A mobile screen having a "T"-shape for use on a ground surface comprising:

a base section having at least one panel providing a first surface having a first surface treatment and a second surface having a second surface treatment;

an end section having at least one panel providing a first surface having a first surface treatment and a second surface having a second surface treatment;

the base section being rigidly coupled to the end section to form the "T"-shape;

wherein at least one surface treatment of the base section or the end section is a functional surface treatment intended to selectively provide for the display of information and at least one surface treatment of the base section or the end section is a decorative surface treatment intended to provide an ornamental effect.

2. The screen of claim 1 wherein at least one surface treatment comprises a writable surface.

3. The screen of claim 1 wherein at least one surface treatment comprises a translucent surface.

4. The screen of claim 1 wherein at least one panel of the base section comprises a wood veneer panel.

5. The screen of claim 1 wherein at least one panel of the base section comprises a plastic laminate panel.

6. The screen of claim 1 wherein at least one panel of the base section comprises a decorative panel.

7. The screen of claim 1 wherein the at least one surface treatment comprises a tackable surface.

8. The screen of claim 1 wherein at least one panel of the end section comprises a functional panel.

9. The screen of claim 8 wherein at least one panel of the base section comprises a functional panel.

10. The screen of claim 1 wherein the base section comprises two panels and the end section comprises two panels.

11. The screen of claim 1 wherein the at least one surface treatment comprises a corkboard.

12. The screen of claim 1 further comprising a wheel coupled to the base section and a set of wheels coupled to the end section adapted to allow the screen to be rolled along the surface.

13. The screen of claim 1 wherein the base section includes a vertical frame member and the end section includes a set of vertical frame members.

14. The screen of claim 1 wherein the base section has a length and the end section has a length, the length of the base section being greater than the length of the end section.

15. The screen of claim 1 wherein at least one surface treatment is writable.

16. The screen of claim 1 further comprising a horizontal frame member dividing the first surface treatment of the base section and the second surface treatment of the base section.

17. The screen of claim 1 wherein the base section includes a top panel and a bottom panel.

18. The screen of claim 1 further comprising at least one "T"-frame having a base frame member coupled to an end frame member and the "T"-frame rigidly couples the base section to the end section to form the "T"-shape.

19. The screen of claim 18 wherein the base frame member is attached to the base section and the end frame member is attached to the end section.

20. The screen of claim 19 further comprising a connector for attaching the base frame member to the end frame member.

21. An apparatus for use in a work environment providing at least one work space comprising:

at least one "T"-shaped mobile screen having a base section with at least one base panel and an end section with at least one end panel; an upper "T"-frame and a lower "T"-frame, each "T"-frame including a base frame member coupled to an end frame member; and a base vertical frame member coupled to the base section, a first end vertical frame member coupled to the end section and a second end vertical frame member coupled to the end section;

wherein the at least one mobile screen is adapted to display information and movable between a first arrangement wherein the work space is formed into at least one work area and at least one second arrangement wherein the work space is formed into at least two work areas.

22. The apparatus of claim 21 wherein the at least one mobile screen comprises a mobile screen and the at least one base panel includes at least one functional panel that is revealed when the mobile screen is in the first arrangement.

23. The apparatus of claim 22 wherein the mobile screen is stowed adjacent to an article of furniture in the first arrangement and deployed from the article of furniture in the second arrangement.

24. The apparatus of claim 23 wherein the base section of the mobile screen is adjacent to the article of furniture in the first arrangement.

25. The apparatus of claim 21 wherein the base section includes at least one base panel and the end section includes at least one end panel with a surface having a functional surface treatment.

26. The apparatus of claim 21 wherein one base panel is a functional panel and one end panel is a functional panel.

27. The apparatus of claim 21 wherein the at least one mobile screen comprises two mobile screens.

28. The apparatus of claim 24 wherein the article of furniture is a storage unit having a side that is substantially concealed when the mobile screen is in the first arrangement.

29. The apparatus of claim 25 wherein the base panel extends from the base vertical frame member and the end panel extends between the first end vertical frame member and the second end vertical frame member.

30. The apparatus of claim 29 wherein the base vertical frame member and the "T"-frame have at least one groove for receiving at least one of the base panel or the end panel.

31. The screen of claim 30 further comprising at least one horizontal frame member having a plurality of grooves and dividing a first base panel and a second base panel.

32. The screen of claim 31 wherein the grooves of the horizontal frame member are configured to receive the first base panel and the second base panel.

33. A screen having a "T"-shape comprising:

a base section having a vertical frame member with a vertical track and at least one base panel extending therefrom to provide a first surface having a first surface treatment and a second surface having a second surface treatment;

an end section having a pair of vertical frame members each with a vertical track with at least one end panel extending therebetween to provide a first surface having a first surface treatment and a second surface having a second surface treatment;

wherein the base section is rigidly coupled to the end section to form the "T"-shape;

wherein at least one surface treatment of the base panel of the base section or the end panel of the end section is a functional surface treatment intended to provide for the display of information; and wherein the base panel is installed at least partially within the track of the vertical frame member of the base section and the end panel is installed at least partially within the track of each vertical base member of the end section.

34. The screen of claim 33 wherein the base section is coupled to the end section at a vertical frame piece joined between the base panel and the end panel.

35. The screen of claim 33 wherein a wheel is provided at a base of the vertical frame member of the base panel and a wheel is provided at a base of each of the pair of vertical frame members of the end section so that the screen can be rolled along a floor.

36. The screen of claim 33 wherein the at least one base panel includes at least one functional panel and the at least one end panel includes at least one functional panel.

37. The screen of claim 36 wherein the at least one base panel includes at least one decorative panel and the at least one end panel includes at least one decorative panel.

38. The screen of claim 36 wherein the at least one surface treatment is a writable surface.

39. The screen of claim 35 further comprising a tray attached to the end section.

40. The screen of claim 39 further comprising a handle attached to the base section.

41. The apparatus of claim 36 wherein the functional panel is translucent and writable.

42. The apparatus of claim 36 wherein the functional panel is generally clear.

43. A mobile screen comprising:

a base section having a first side edge and a second side edge;

an end section having a first side edge and a second side edge;

a handle coupled to the base section;

a base vertical frame member coupled to the base section and a set of end vertical frame members coupled to the end section; and a supplemental weight associated with at least one of the vertical frame members;

wherein the second side edge of the base section is connected to the end section at a point between the first and second side edges of the end section.

44. The mobile screen of claim 43 wherein the handle is connected to the first side edge of the base section.

45. The mobile screen of claim 43 further comprising a tray connected to the end section.

46. The mobile screen of claim 43 wherein the supplemental weight is a ballast material for providing stability.

47. The mobile screen of claim 43 wherein the supplemental weight is a solid rod configured for installation in the vertical frame member.

48. The mobile screen of claim 46 wherein the vertical frame members are at least partially hollow.

49. The mobile screen of claim 48 wherein the supplemental weight is installed near the bottom of the vertical frame member.

50. The mobile screen of claim 49 wherein the second side edge of the base section substantially bisects the end section.

* * * * *